US009289080B1

(12) United States Patent
Mchatet

(10) Patent No.: US 9,289,080 B1
(45) Date of Patent: Mar. 22, 2016

(54) RAIL ASSEMBLY LOCK

(71) Applicant: Hamid Mchatet, Miami, FL (US)

(72) Inventor: Hamid Mchatet, Miami, FL (US)

( * ) Notice: Subject to any disclaimer, the term of this patent is extended or adjusted under 35 U.S.C. 154(b) by 0 days.

(21) Appl. No.: 14/276,538

(22) Filed: May 13, 2014

(51) Int. Cl.
*A47F 5/08* (2006.01)
*E05B 15/00* (2006.01)

(52) U.S. Cl.
CPC ..... *A47F 5/0861* (2013.01); *E05B 15/00* (2013.01)

(58) Field of Classification Search
CPC ... E05B 15/00; E05B 73/0017; A47F 5/0807; A47F 5/0861
USPC ..... 70/14, 57, 57.1, 58; 211/7, 57.1, 59.1; 248/220.21, 220.22, 221.11, 222.11, 248/222.51
See application file for complete search history.

(56) References Cited

U.S. PATENT DOCUMENTS

| | | | | |
|---|---|---|---|---|
| 4,991,413 | A * | 2/1991 | Arnaldo | 70/19 |
| 5,259,220 | A * | 11/1993 | Fredrickson | 70/14 |
| 5,275,027 | A | 1/1994 | Eklof et al. | |
| 5,624,040 | A | 4/1997 | Hono | |
| 5,711,432 | A | 1/1998 | Stein et al. | |
| 5,996,817 | A | 12/1999 | Kao | |
| 6,076,669 | A | 6/2000 | Ling | |
| 6,837,373 | B2 | 1/2005 | Huang | |
| 6,854,594 | B2 | 2/2005 | Vasudeva et al. | |
| 6,957,555 | B1 | 10/2005 | Nagel et al. | |
| 7,137,513 | B2 | 11/2006 | Sedon et al. | |
| 7,269,983 | B1 * | 9/2007 | Mchatet et al. | 70/14 |
| 7,350,645 | B1 | 4/2008 | Sills | |
| 7,624,871 | B2 | 12/2009 | Sills | |
| 8,667,818 | B1 * | 3/2014 | Mchatet | 70/14 |
| 2005/0230587 | A1 | 10/2005 | Yang | |
| 2005/0279894 | A1 * | 12/2005 | Sedon et al. | 248/175 |
| 2010/0126238 | A1 * | 5/2010 | Mazzucchelli | 70/58 |
| 2010/0170307 | A1 * | 7/2010 | Rizzi | 70/58 |

FOREIGN PATENT DOCUMENTS

| | | | | |
|---|---|---|---|---|
| EP | 1199012 | A1 * | 4/2002 | A47F 5/08 |

* cited by examiner

*Primary Examiner* — Lloyd Gall
*Assistant Examiner* — Amanda L Miller
(74) *Attorney, Agent, or Firm* — Albert Bordas, P.A.

(57) ABSTRACT

A rail assembly lock having a lock assembly with a hinge assembly, a key assembly, and a rail assembly. The lock assembly mounts onto the rail assembly, and the key assembly is used to unlock the lock assembly. The rail assembly has first and second rail members kept at a spaced apart relationship with respect to each other by a transversal member. The first and second rail members have curvatures next to distal ends. Packaging containing products suspend from the first and second rail members between the curvatures and the transversal member. The lock assembly has a top wall, a bottom wall, first and second sidewalls, a front wall, and upper and lower interior walls. Defined at the lower interior wall is an aperture. Extending from the upper interior wall towards the aperture is a locking shaft assembly. The locking shaft assembly has a shaft having an end.

1 Claim, 3 Drawing Sheets

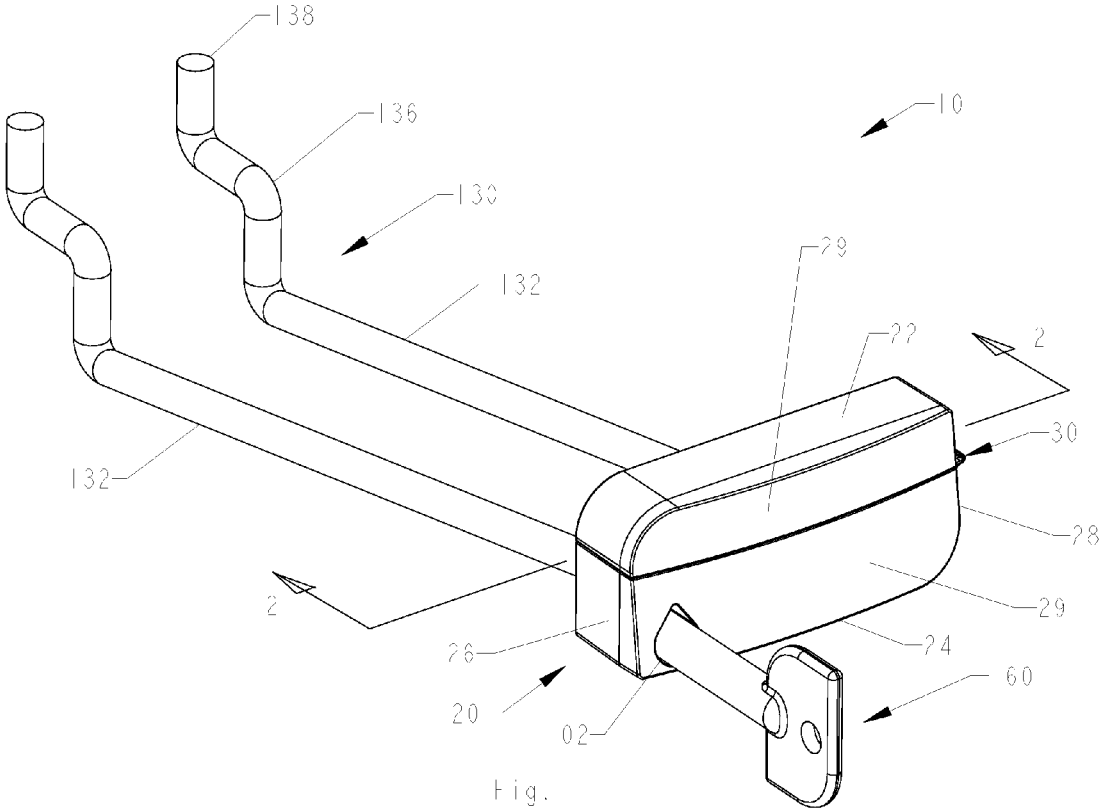
Fig.
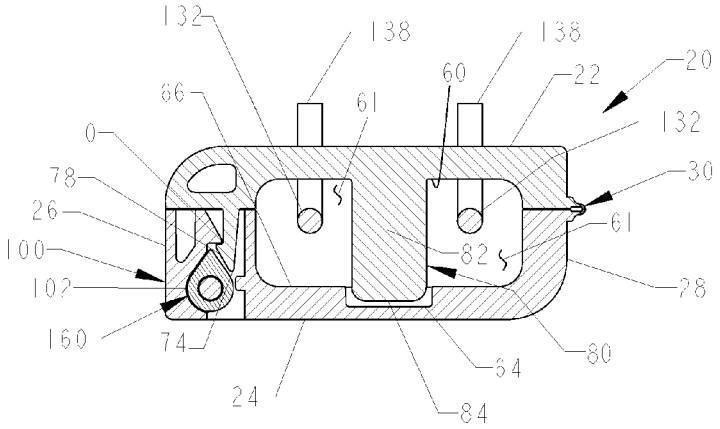
Fig. 2

RAIL ASSEMBLY LOCK

BACKGROUND OF THE INVENTION

1. Field of the Invention

The present invention relates to lock assemblies, and more particularly, to locking systems for rail assemblies having packaging suspended therefrom.

2. Description of the Related Art

Applicant believes that one of the closest references corresponds to Applicant's own U.S. Pat. No. 7,269,983 issued on Sep. 18, 2007 for a lock assembly. However, it differs from the present invention because Applicant then taught a lock assembly including a lock, a key and a rail assembly. The lock includes a lock housing and an actuating housing. The lock housing includes a rear notch, an internal notch that houses a spring and a locking tab, and an aperture that houses a second spring. A vertical track member is mounted to the rear notch and has a vertical cutout. The actuating housing includes rear, lateral and top walls and a protrusion with a notch. The actuating housing is slidably mounted to the lock housing with a pin. The rail assembly is mounted to racks in stores wherein products for display are mounted thereto. The lock mounts onto the rail assembly by inserting the transversal member of the rail behind the protrusion and pressing the actuating housing against the lock housing until the locking tab engage into the notch.

Applicant believes that another reference corresponds to U.S. Patent Application Publication No. 20050230587 A 1, published on Oct. 20, 2005 to Yang for a display device for article for sale. However, it differs from the present invention because Yang teaches a display device including a plug device having a housing engageable into a hole of an article for sales, the housing includes a chamber and a spring blade having a projection to engage into a depression of the article, and for detachably attaching the housing to the article. A hanger device includes an actuator engageable into the chamber of the housing, to selectively engage with the spring blade of the housing, and to force and retain the projection of the spring blade within the depression of the article, and thus to detachably lock the housing to the article with the actuator of the hanger device. A locking device may be used to lock the actuator of the hanger device to the housing of the plug device.

Applicant believes that another reference corresponds to U.S. Pat. No. 7,624,871 B2 issued to Sills on Dec. 1, 2009 for a product security system for hanging merchandise. However, it differs from the present invention because Sills teaches a security system for preventing theft of hanging merchandise comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,350,645 B1 issued to Sills on Apr. 1, 2008 for a product security system for hanging merchandise. However, it differs from the present invention because Sills teaches a security system for preventing theft of hanging merchandise comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,137,513 B2, issued on Nov. 21, 2006 to Sedon, et al. for a merchandise display system. However, it differs from the present invention because Sedon, et al. teaches a merchandise display system including a rod lockably connected to a peg board, a hanging member hanging from the rod and a swivel member rotatably connected to the hanging member about a first axis. The swivel member is connected to a lockable display case for carrying an item of merchandise and is rotatable about a second axis perpendicular to the first axis. Thus, the display case is rotatable about the first and second axes to facilitate viewing the merchandise from any angle while the case is lockably connected to the rod. The hanging and swivel members may be a ball and socket combination. Alternately, the swivel member may connect to the display case via a hinge pin about which portions of the case may rotate to open and close. Alternately, a lower member may extend from within the case through holes therein to rotatably connect to the swivel member about the second axis.

Applicant believes that another reference corresponds to U.S. Pat. No. 6,957,555 B1 issued to Nagel, et al. on Oct. 25, 2005 for a locking attachment for product display hooks. However, it differs from the present invention because Nagel, et al. teaches a merchandise locking device for retrofit attachment to a product display hook installed on a merchandise display panel. The locking device attaches without tools to the upper wire arm of the display hook for pivoting movement between "lock" and "open" positions. A laterally opening recess in the locking device receives the lower arm of the display hook and a locking arm, rotatably mounted in the body of the locking device by a rotor element, closes the recess to lock the device to the lower arm and prevent the removal of merchandise therefrom. A simple key carried by store personnel enables the rotor to be released to free the locking device from the lower arm and permit the removal of merchandise. The locking device consists of four elements, including the key, and can be manufactured at very low cost, suitable for mass merchandise applications. Simple changes in rotor components enable the locking device to be operated by different keys, which may be color coded with the locking devices or components thereof. A bracket is also provided for retrofit attachment to the display hook, to prevent bodily removal of the hook and its contents from the display panel.

Applicant believes that another reference corresponds to U.S. Pat. No. 6,854,594 B2 issued to Vasudeva, et al. on Feb. 15, 2005 for a product holder with point-of-sale security. However, it differs from the present invention because Vasudeva, et al. teaches a point-of-sale security system. The security system includes a container for containing the product and a holder assembly, the holder assembly including a closure device for closing the container. The holder assembly and the container are operatively coupled together by means of cooperative members. The cooperative members being configured in a special way, i.e., when an associated stop member is enabled, the cooperative members prevent decoupling of the holder assembly from the container, and when the stop member is disabled, the cooperative members enable decoupling of the holder assembly from the container.

Applicant believes that another reference corresponds to U.S. Pat. No. 6,837,373 B2 issued to Huang on Jan. 4, 2005 for a tool suspension device with a burglarproof feature. However, it differs from the present invention because Huang teaches a tool suspension device for pliers having a suspension board and a bracket. The suspension board has a front, a rear, a clip and a removable locking stub. The clip is mounted on the rear of the suspension board. The removable locking stub is attached to the front of the suspension board. The bracket is mounted on the front of the suspension board and has a U-shaped frame and clamping arms inside the frame. A tool slot is defined vertically through the frame and is adapted to hold a tool that is positioned head down. The removable locking stub prevents upward movement of the tool to prevent the tool from being easily pulled out of the tool slot to steal. The clip is used to hang the tool suspension device on a person's belt. Therefore, the tool suspension device is burglarproof and double-duty.

Applicant believes that another reference corresponds to U.S. Pat. No. 6,076,669 B1 issued to Ling on Jun. 20, 2000 for a tool display rack. However, it differs from the present invention because Ling teaches a tool display rack including a body with a first engaging member extending from the first end thereof in which a first aperture is defined, a limiting member connected to the body at its first end by a connecting plate and having a recess defined therein, a second engaging member extending from the second end of the limiting member so as to engage with the first aperture, a second aperture defined in the second end of the limiting member so as to receive the first engaging member so that a tool extends through the recess between the body and the limiting member and is limited by the limiting member. The tool can only be taken away from the body by cutting the second engaging member extending through the first aperture in the body.

Applicant believes that another reference corresponds to U.S. Pat. No. 5,996,817 B1 issued to Kao on Dec. 7, 1999 for a tool suspension rack assembly. However, it differs from the present invention because Kao teaches a suspension rack having a base plate defining at least one hole, at least one suspension plate defining a slot, and at least one fastener member including an abutting plate abutting a first side of the suspension plate. A lug extends from the abutting plate and is received in the slot. A snapping member having a stub extends from the lug and is received in the hole. An enlarged cone-shaped head extends from the stub and abuts a second side of the base plate.

Applicant believes that another reference corresponds to U.S. Pat. No. 5,711,432 B1 issued to Stein, et al. on Jan. 27, 1998 for a pilfer-resistant peg hook assembly. However, it differs from the present invention because Stein, et al. teaches a pilfer-resistant peg hook assembly for supporting a plurality of articles incorporating defined slots and enabling only one article at a time to be removed therefrom. It is formed of a peg hook and a flipper. The peg hook has a pair of opposed ends and a body connecting the same. One of the hook ends is configured and dimensioned to maintain the hook body in a substantially horizontal first plane when mounted on an appropriate surface, and the other of the hook ends is a free end. The hook body is configured and dimensioned to be received in the slots of the articles and extends only in the first plane. The flipper is pivotably secured adjacent the free end and is movable between an enabling orientation enabling at least partial passage of an article along the hook body and onto the flipper as the article initially moves towards the free end, and a blocking orientation precluding passage of an article onto the flipper as the article moves towards the free end. The flipper is cammed into the blocking orientation as the article continues to pass over the flipper towards the free end.

Applicant believes that another reference corresponds to U.S. Pat. No. 5,624,040 B1 issued to Hono on Apr. 29, 1997 for a theft-preventive display hook system. However, it differs from the present invention because Hono teaches a security system for a display rack in which merchandise in packages is threaded through an opening in the packaging over the free end of a hanger rod for display. The free end of the hanger rod is threaded, and a threaded cap is treated onto the free end of the rod to prevent removal of the package. The cap has a pair of opposed grooves, and a special key is provided to remove the cap.

Applicant believes that another reference corresponds to U.S. Pat. No. 5,275,027 B1 issued to Eklof, et al. on Jan. 4, 1994 for a security device for merchandise display hooks. However, it differs from the present invention because Eklof, et al. teaches a security device for use on pegboard type hooks. The device includes a housing with a lock mechanism, which releasably locks with the tines of a latch to securely grip the rod of the pegboard hook. A simple key-operated camming cylinder is manually operated to release the latch so that merchandise products carried on hook can be removed. The latch can be inserted into the housing and relocked on the hook without using the key.

Other patents describing the closest subject matter provide for a number of more or less complicated features that fail to solve the problem in an efficient and economical way.

SUMMARY OF THE INVENTION

The instant invention is a rail assembly lock, comprising a lock assembly having a hinge assembly, a key assembly, and a rail assembly. The lock assembly mounts onto the rail assembly, and the key assembly is used to unlock the lock assembly from the rail assembly.

The rail assembly comprises at least first and second rail members kept at a spaced apart relationship with respect to each other by a transversal member. The at least first and second rail members have curvatures next to distal ends. Packaging containing products suspend from the at least first and second rail members between the curvatures and the transversal member.

The lock assembly comprises a top wall, a bottom wall, first and second sidewalls, and a front wall. The lock assembly further comprises upper and lower interior walls. Defined at the lower interior wall is an aperture. Extending from the upper interior wall towards the aperture is a locking shaft assembly. The locking shaft assembly comprises a shaft having an end.

The lock assembly further comprises rail channels to receive the at least first and second rail members to permit removal of the lock assembly and then the packaging therefrom when the lock assembly is in an unlocked position by releasing the locking shaft assembly.

The rail assembly further comprises locking means, wherein the lock assembly mounted to the transversal member, is placed in a locked position, whereby the transversal member is blocked by the locking shaft assembly. The transversal member is sandwiched by the locking shaft assembly and the front wall.

The lock assembly further comprises a locking assembly. The locking assembly comprises a shaft extending from a base at an upper joint wall, to an end. Extending from the end is an angled edge. The angled edge is wider than the shaft to define a catch. The lock assembly further comprises a latch assembly. The latch assembly receives the locking assembly to place the lock assembly in a locked position. The latch assembly comprises a keyhole, and an aperture at a lower joint wall. Extending from the aperture are an interior sidewall, and an interior angled sidewall that terminates at a locking latch.

The key assembly is cooperatively shaped to fit within the keyhole to actuate and cause the locking assembly to shift from the locked position to an unlocked position.

The rail assembly lock further comprises unlocking means, wherein the key assembly is presented into the latch assembly to cause the locking shaft assembly to shift from a locked position, to an unlocked position, whereby the locking shaft assembly does not block the transversal member to permit removal of the packaging from the rail assembly.

The key assembly is presented into the keyhole and rotated by placing a predetermined force for a predetermined distance against the angled edge until no longer obstructed by the locking latch to enable the locking shaft assembly to shift from the locked position, to an unlocked position.

It is therefore one of the main objects of the present invention to provide a rail assembly lock that prevents unauthorized individuals from removing retail packaging from a rack or display having rail assemblies.

It is another object of the present invention to provide a rail assembly lock that can be readily mounted and unmounted from racks or displays having rail assemblies without tools.

It is another object of the present invention to provide a rail assembly lock that minimizes locking and unlocking time.

It is another object of the present invention to provide a rail assembly lock that is volumetrically efficient for carrying, transporting, and storage.

It is another object of the present invention to provide a rail assembly lock that is of a durable and reliable construction.

It is yet another object of the present invention to provide a rail assembly lock that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is a first isometric view of a rail assembly lock in a locked position and mounted onto a rail assembly, with a key assembly inserted therein.

FIG. 2 is a cross section view taken along lines 2-2 from FIG. 1.

DETAILED DESCRIPTION OF THE PREFERRED EMBODIMENT

Figure 3:
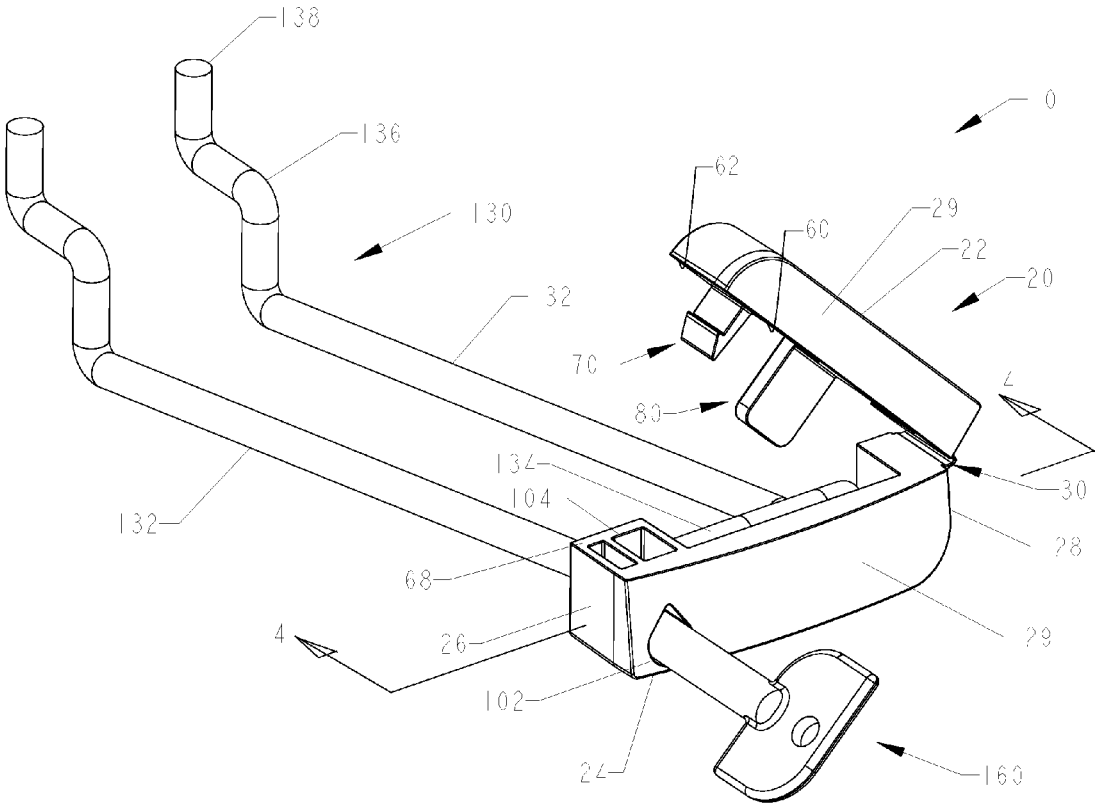
FIG. 3 is a second isometric view of the rail assembly lock in an unlocked position and still mounted onto the rail assembly, with the key assembly inserted therein and rotated to a predetermined angle.

Referring now to the drawings, the present invention is a rail assembly lock for retail packaging having contents therein, and is generally referred to with numeral 10.

As seen in FIGS. 1 and 2, present invention 10 comprises lock assembly 20, hinge assembly 30, rail assembly 130, and key assembly 160. Lock assembly 20 mounts onto rail assembly 130, and key assembly 160 is used to unlock lock assembly 20 from rail assembly 130.

Rail assembly 130, having a duel rail member configuration, includes rail members 132 kept at a parallel and spaced apart relationship with respect to each other by transversal member 134. Rail members 132 have curvatures 136 next to distal ends 138. A plurality of rail assemblies 130 are usually mounted to display racks in stores, not seen. Packaging containing products, not seen, typically suspend from rail members 132 between curvatures 136 and transversal member 134. Furthermore, rail assembly 130 may extend from a free-standing display rack, or other display assemblies having rail members 132 from which packaging may hang therefrom.

Lock assembly 20 comprises top wall 22, bottom wall 24, sidewalls 26 and 28 and front wall 29. Lock assembly 20 further comprises upper and lower interior walls 60 and 66. Defined at lower interior wall 66 is aperture 64. Extending from upper interior wall 60 towards aperture 64 is locking shaft assembly 80. Locking shaft assembly 80 comprises shaft 82 having end 84. Lock assembly 20 further comprises rail channels 61 to receive rail members 132 to permit removal of lock assembly 20 and then packaging therefrom when lock assembly 20 is in an unlocked position by releasing locking shaft assembly 80, as best seen in FIGS. 3 and 4.

As locking means, lock assembly 20 mounted to transversal member 134, seen in FIG. 3, is placed in a locked position, whereby transversal member 134 is blocked by locking shaft assembly 80, seen in FIG. 2, to prevent removal of packaging therefrom. Transversal member 134 is sandwiched by locking shaft assembly 80 and front wall 29 in a way that lock assembly 20 cannot be neither removed from rail assembly 130 nor slid back onto rail members 132.

Figure 4:
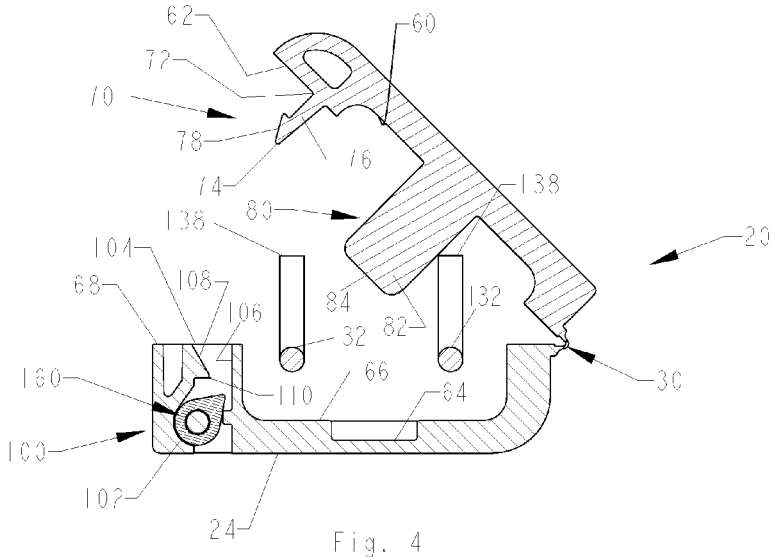
FIG. 4 is a cross section view taken along lines 4-4 from FIG. 3.

As seen in FIGS. 3 and 4, lock assembly 20 further comprises locking assembly 70. Locking assembly 70 comprises shaft 76 extending from base 72 at upper joint wall 62, to end 74. Extending from end 74 is angled edge 78. It is noted that angled edge 78 is wider than shaft 76 to define a catch.

As best seen in FIG. 4, lock assembly 20 further comprises latch assembly 100. Latch assembly 100 receives locking assembly 70 to place lock assembly 20 in the locked position. Latch assembly 100 comprises keyhole 102, and aperture 104 at lower joint wall 68. Extending from aperture 104 are interior sidewall 106, and interior angled sidewall 108 that terminates at locking latch 110.

Figure 5:
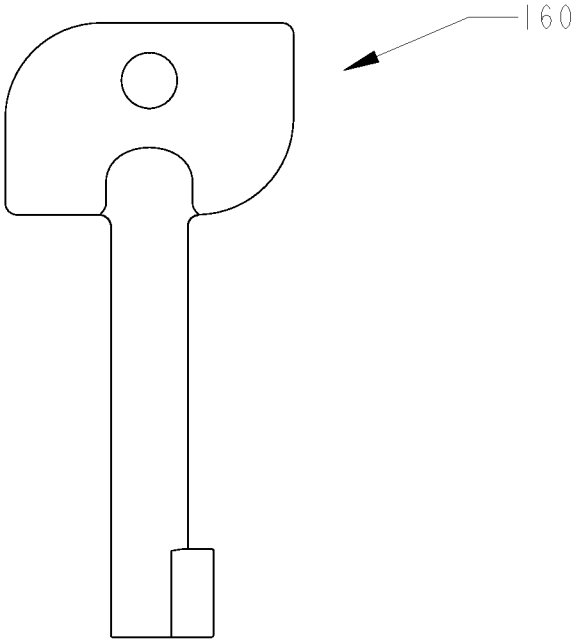
FIG. 5 is a front elevation view of the key assembly.
Figure 6:
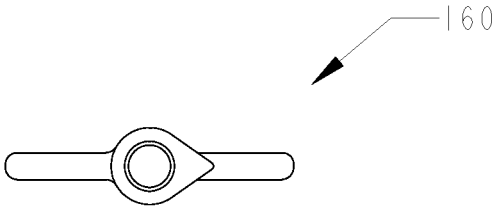
FIG. 6 is a bottom view of the key assembly.

Seen in FIGS. 5 and 6 is key assembly 160. Key assembly 160 can be any key cooperatively shaped to fit within key hole 102 to actuate and cause locking assembly 70 to shift from the locked position seen in FIG. 2, to the unlocked position seen in FIG. 4.

As unlocking means, key assembly 160 is presented into latch assembly 100, comprising keyhole 102, to cause locking shaft assembly 80 to shift from the locked position, to an unlocked position, whereby locking shaft assembly 80 does not block transversal member 134 to permit removal of packaging from rail assembly 130. More specifically, key assembly 160 is presented into keyhole 102. Key assembly 160 is then rotated by placing a predetermined force for a predetermined distance against angled edge 78 until no longer obstructed by locking latch 110 to enable locking shaft assembly 80 to shift from the locked position, to an unlocked position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A rail assembly lock, comprising:

A) a lock assembly having a top wall that extends to an edge, a bottom wall, first and second sidewalls, a front wall, upper and lower interior surfaces formed on interior portions of the top and bottom walls respectively, and a hinge assembly at said first sidewall, inset into said lower interior surface is a recess, said recess is perpendicularly disposed with regard to said lower interior surface, perpendicularly extending a first predetermined distance from said upper interior surface towards said recess is a locking shaft assembly comprising a first shaft having a first end, said lock assembly further comprises a locking assembly having a second shaft positioned at a second predetermined distance from said edge, said second shaft extends from a base at an upper joint surface to a second end, extending from said second end is an angled edge, said first predetermined distance is longer than said second predetermined distance, said upper joint surface is parallel to but non-planar with said upper interior surface;

B) a key assembly; and

C) a rail assembly, said lock assembly mounts onto said rail assembly, and said key assembly is used to unlock said lock assembly from said rail assembly, said rail assembly comprises first and second rail members kept at a spaced apart relationship with respect to each other by a transversal member, said first and second rail members have curvatures next to distal ends, packaging containing products suspend from said first and second rail members between said curvatures and said transversal member, said lock assembly further comprises rail channels to receive said first and second rail members to permit removal of said lock assembly and then said packaging therefrom when said lock assembly is in an unlocked position by releasing said locking shaft assembly, said lock assembly is mounted to said transversal member and is placed in a locked position, whereby said transversal member is blocked by said locking shaft assembly, said transversal member is sandwiched by said locking shaft assembly and said front wall, said angled edge is wider than said second shaft to define a catch, said lock assembly further comprises a latch assembly, said latch assembly receives said locking assembly to place said lock assembly in said locked position, said latch assembly comprises a keyhole, and an aperture at a lower joint surface, defining said aperture is an interior sidewall, and an interior angled sidewall that terminates at a locking latch, said key assembly is cooperatively shaped to fit within said keyhole to actuate and cause said locking assembly to shift from said locked position to said unlocked position whereby said key assembly is presented into said latch assembly to allow said top wall to be pivoted from a closed position where said top and bottom walls are parallel to one another to an open position where said top wall is pivoted on said hinge assembly away from said bottom wall to cause said locking shaft assembly to shift from said locked position to said unlocked position, wherein said locking shaft assembly does not block said transversal member to permit removal of said packaging from said rail assembly, further comprising unlocking means, wherein said key assembly is presented into said keyhole and rotated by placing a predetermined force against said angled edge until no longer obstructed by said locking latch to enable said locking shaft assembly to shift from said locked position to said unlocked position, said upper interior surface is positioned between said second shaft and said hinge assembly, said lower interior surface is positioned between said keyhole and said hinge assembly, and said upper joint surface is substantially flush with said lower joint surface when said top and bottom walls are in said closed position.

* * * * *